United States Patent [19]

Fanti

[11] Patent Number: 4,569,528

[45] Date of Patent: Feb. 11, 1986

[54] DOT GAME DEVICE

[76] Inventor: Roy Fanti, 171 Atwater Rd., Springfield, Mass. 01107

[21] Appl. No.: 630,407

[22] Filed: Jul. 13, 1984

[51] Int. Cl.[4] ..... A63F 3/00

[52] U.S. Cl. ..... 273/267

[58] Field of Search ..... 273/267, 275, 284

[56] References Cited

U.S. PATENT DOCUMENTS

| | | | |
|---|---|---|---|
| 1,342,884 | 6/1920 | Anderson | 273/267 |
| 1,666,359 | 4/1928 | Steves | 273/267 |
| 1,689,984 | 10/1928 | Walton | 273/267 X |
| 2,520,207 | 8/1950 | Graham | 273/267 X |
| 3,460,834 | 12/1969 | Nickel | 273/267 X |
| 3,863,926 | 2/1975 | White | 273/267 |
| 4,138,115 | 2/1979 | Gans | 273/156 X |
| 4,260,158 | 4/1981 | Lohn | 273/267 |
| 4,411,432 | 10/1983 | Stevens | 273/251 |

FOREIGN PATENT DOCUMENTS

| | | | |
|---|---|---|---|
| 2023 | of 1871 | United Kingdom | 273/284 |

*Primary Examiner*—Harland S. Skogquist

*Attorney, Agent, or Firm*—Harvey B. Jacobson

[57] ABSTRACT

A game device utilizing the old and well known concept of connecting adjacent dots of a matrix of dots by utilizing a connecting line formed by a player during his period of play. In this known type of game device, the matrix of dots is usually arranged periodically in a horizontal and vertical array with the purpose of the game being to complete more squares than an opponent. The present invention provides a tri-level gameboard with each level having a number of dots thereon with each level also including a predetermined number of fixed and optional "stops" that are distinguishable by color and/or configuration to prevent a player from capturing the enclosed shape, such as a square, triangle or the like having any side composed of a "stop" thereby introducing the use of skill and strategic planning by the players inasmuch as a player, by judicious use of the "stops" can decisively control the outcome of the game.

12 Claims, 6 Drawing Figures

FIG. 1
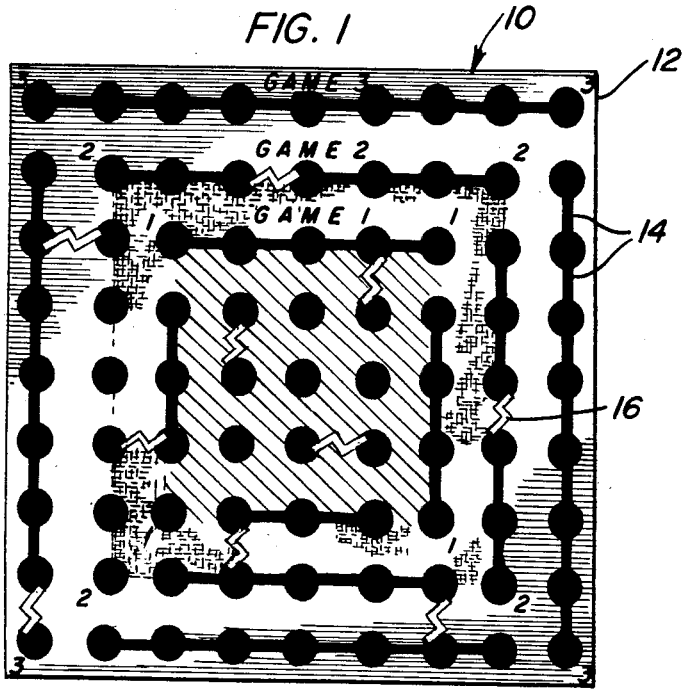
FIG. 2
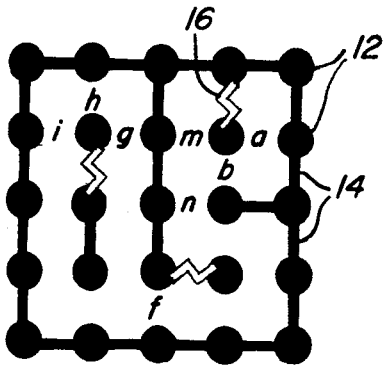
FIG. 3
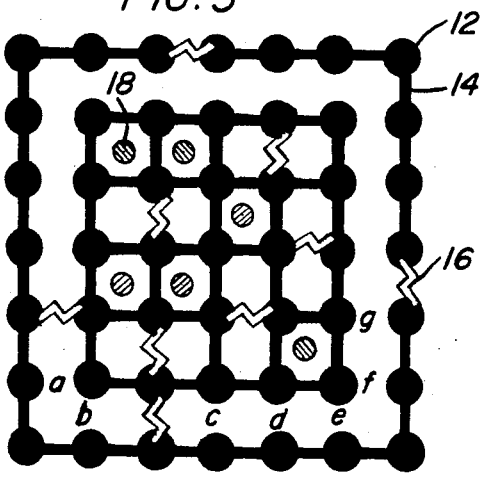
FIG. 4
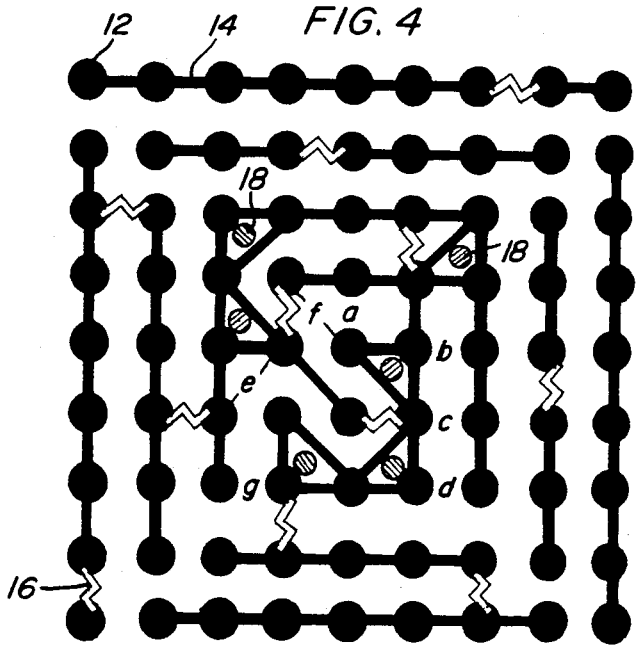
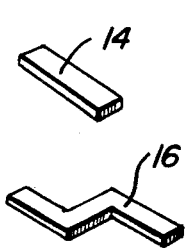
FIG. 5
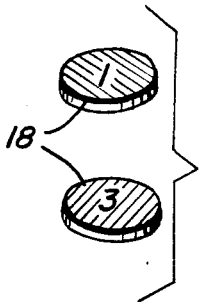
FIG. 6

DOT GAME DEVICE

BACKGROUND OF THE INVENTION

Field of the Invention

An object of the present invention is to provide a dot game device in the form of a gameboard having a plurality of dots delineated thereon arranged in a vertical and horizontal array together with game pieces and markers to enable the dots to be connected in a particular manner by connecting segments and game pieces to be placed in square areas encompassed by the segments to indicate that one player has captured or occupied that area.

Another object of the invention is to provide a dot game device in accordance with the preceding object in which the game device includes a tri-level feature and may be provided optionally with some or all fixed "stops" in lieu of or in combination with the selectively positionable "stops" or provided only with optional "stops".

A further object of the invention is to provide a dot game device in accordance with preceding objects which converts a previously known game from a game which lacks in mental stimulation or strategic challenge to the players to a game device requiring and thus developing playing skills and strategic planning by enabling the players to decisively control the outcome of the game by judiciously employing the "stops".

Still another object of the invention is to provide a dot game device in which the degree of complexity may be varied as the players gain more skills in stragetic planning with the game device being relatively simple in construction and inexpensive to manufacture but yet interesting and mentally stimulating.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a plan view of the game device of the present invention illustrating one stage of play thereof.

FIG. 2 is a plan view illustrating Game 1 in one stage of play.

FIG. 3 is a plan view illustrating Game 2 in one stage of play.

FIG. 4 is a plan view illustrating Game 1 in one stage of play of an advanced game allowing completion of triangles and squares.

FIG. 5 is a group perspective view illustrating the the structure of the connecting segments and "stops".

FIG. 6 is a perspective view of the game pieces used as markers for a completed square or triangles.

DESCRIPTION OF THE PREFERRED EMBODIMENT

The game device of the present invention includes a gameboard 10 of generally square or rectangular configuration and having a generally planar upper surface with the gameboard being constructed of heavy cardboard or similar material having a plurality of dots 12 formed thereon which are arranged in a plurality of horizontal and vertical arrays and which includes a central dot and a plurality of concentrically arranged rows of dots encircling the central dot. The gameboard

10 includes a tri-level arrangement of games distinguished by background color with the rows of five dots defining Game 1 being designated with the numeral 1 and having a green background with this are being defined by five dots on a side as indicated in FIG. 1. Game 2 is the next outer concentric row of dots as indicated by numeral 2 at the four corners thereof with the background color between games 1 and 2 being yellow. Game 3 is the outside row of dots with the four corners being designated by numeral 3 with the background of the area outwardly of the dots forming the Game 2 having a background color of blue.

A plurality of connecting segments or "connectors" 14 are provided which are of a length to extend between and connect the dots 12. Also, a plurality of stop elements or "stops" 16 are provided which are generally of offset configuration, Z-shaped or wiggly when used to connect adjacent dots 12 as illustrated in FIGS. 1–4. FIG. 6 illustrate one of a plurality of marker discs or token 18 which may be placed in the squares indicating that a particular player has captured or occupied that square. The tokens 18 are of different colors so that each player may select a particular color for use in subsequent play of the game. The straight line connecting segments 14 are preferably black in color and the stop segments 16 are preferably red.

In playing the game, the black segments or connectors 14 are used to connect adjacent dots either horizontally or vertically to form the sides of the squares that each player is trying to complete and capture in the basic or beginner game arrangement. In a more advanced game arrangement, the connector segments are also used to connect adjacent diagonal dots as well as the adjacent vertical and horizontal dots as players try to capture both squares and triangles. The red stops 16 are used by the players to connect adjacent dots in an effort to block or prevent the opponents from completing and thereby capturing squares in the beginner game or squares and triangles in an advanced game. A square or triangle having one or more sides constructured with a red stop does not qualify as a captured square or triangle and thus cannot be won as a prize and is called a blocked square or blocked triangle respectively.

As indicated previously, the Game 1 gameboard is located at the center of the board 10 and has a background color of green and includes five dots on each side. As illustrated in FIG. 2, most of the adjacent dots have already been connected with black segments 14 which has been illustrated to explain the strategy to capture squares by the player. Also, note that red stops 16 have been placed at random to connect a few of the adjacent horizontal or vertical dots 12. These stops are called fixed stops and have been positioned in order to stimulate strategic play by the players in preventing opponents from capturing black squares in the beginner game or black squares and black triangles in the advanced game. The Game 2 gameboard as illustrated in FIG. 3 and surrounds the Game 1 gameboard and has a background color of yellow as well as being appropriately marked Game 2 and, in this arrangement, the outer edges of the large square of Game 2 have all the adjacent dots connected with black segments and a few red stop segments 16 have been placed at random sites on the Game 2 board. The Game 3 board, illustrated in FIGS. 1 and 4 immediately surrounds the Game 2 board and has a background color of blue and is appropriately marked as Game 3. The outer edges of the Game 3 board also have most of the dots connected with the black segments and a few red stops placed at random sites thereon.

In playing the game, a black square is made up of four black segments 14 and thus each side of the square must be composed of a black segment. A black triangle is a triangle made up of three black segments with each side of the triangle being a black segment. A blocked square is a square that has one or more of its sides constructed from red stops and a blocked triange is a triangle that has one or more of its sides constructed from red stops.

In starting a beginner game, each player selects the color prize tokens 18 desired and stacks them in a convenient place for subsequent use. Each player than takes one or two or any limited number of red stop segments 16 from the supply of playing pieces and saves it for later play at his option at any time during his turn of play instead of using a black segment. The red stop is very important in blocking an opponent from capturing black squares and thus it is important for the players to learn how and when to use the fixed red stops on the board and the optional stops to best advantage.

The player who goes first takes a black segment and uses it to connect any two adjacent horizontal or vertical dots anywhere on the Game 1 gameboard and the players then alternate playing in turn connecting any two adjacent horizontal or vertical dots anywhere on the Game 1 board trying to be the player to complete and thus capture a black square while at the same time trying to prevent his opponent from doing so. During the first several plays of the players they problably will use only the black segments but a player could use a red stop if he wishes anytime during his play but it is recommended that the red stops be saved for later use in the game. After several turns by each player, it is no longer possible to connect adjacent dots without one of the players having the advantage of completing a black square during his turn. Therefore, it is important that the players carefully select which dots are to be connected in order to minimize the number of black squares an opponent will capture and in this respect, the fixed red stops on the Game 1 board become very important. Sooner or later, one of the players will complete a black square and when this occurs, the player captures that square and is entitled to place his colored token within the square. The player who completed the square must play again. In some instances, the player can complete another black square and he continues play until he can no longer complete a black square or until he is blocked by completing a square with one of its sides constructed with a red stop. When a player is blocked, it then becomes the next player's turn. Thus, in the beginner game, only completed black squares are captured for prizes and when a player completes a black square, he continues his turn until he can no longer complete a black square. During a player's turn, he may use a red stop instead of a black segment but the player has only a limited number to use so they should be used wisely. A blocked square does not count as a prize nor does it entitle the player to go again. Game 1 is over when all the horizontal and vertical spaces between dots have been filled with either black segments or red stops on the Game 1 gameboard and the winner is the player having the largest number of his color prize tokens on the Game 1 gameboard. At this point, a decision has to be made as to whether to play Game 2. If Game 2 is to be played, none of the segments or prize tokens on the Game 1 gameboard are removed with play continuing immediately onto the Game 2 board which is provided with a yellow background color. As in Game 1, each player takes a predetermined number of red stop segments for later play but if three or more players are playing, each player only takes one red stop for later play. The winner of Game 1 goes first and play continues in the same manner as in Game 1. Game 2 ends when all of the adjacents dots on the vertical and horizontal are completed by being connected on the Game 2 board and the winner is determined in the same manner as Game 1. If Game 3 is to be played, all segments and prize tokens are left on the Game 1 and Game 2 gameboards and Game 3 is played on the background color blue and each player takes two stop segments for later play if two players are playing and if three players are playing, each player takes only one red stop for later play. The winner of Game 2 goes first and proceeds in the same manner as in playing Game 1 and Game 2. Game 3 ends when all the adjacent dots on the Game 3 board have been connected and the winner of Game 3 is the player having the largest number of captured squares on the Game 3 gameboard. The winner of a three game beginner match is determined by each player getting one point for winning a game and thus if one player has won all three games he has a total of three points and is the winner. If two players are playing and one of the players has won two of the games that player has 2 points and his opponent 1 point. However, the opponent will still be able to win the draw in the match if he has the largest total number of prizes or tokens on the gameboard obtained by adding up all the squares he has won in Games 1, 2 and 3 since the person with the largest total score has won. If three players have each won 1 game, the winner of the match is the player having the largest total number of captured black squares on the entire gameboard. However, if a fourth player has the largest total, the match is a draw.

In an advanced game, both black squares and black triangles can be captured with the gameboards, basic rules and method of play being substantially the same. In the advanced game, players are allowed in their turn to connect adjacent dots on the diagonal if they so wish. However, only one diagonal segment, either black straight line or red stop, is allowed in any one square. Thus, diagonal lines are not allowed to cross each other. But, triangles may be captured as prizes as well as black squares and is worth 1 point so that the prize token 18 is placed with the No. 1 face up. A captured black square is worth 3 points and the player capturing it places his color prize token within the captured black square with a No. 3 face up. A blocked triangle cannot be captured as a prize nor does it have any point value. Once a black square has been captured as a prize, that black square may not be subsequently divided into black triangles in an attempt to increase the point score. A blocked square, however, may be subsequently divided into a black triangle as long as the three sides of the triangle have only black straight line segments on all three of its sides and the player completing the black triangle is the one who places his color prize token within the triangle so captured. For each of the three games of the advanced game, each player at the start of each game, takes twice the number of red stop segments as allowed in the beginner game and these may be used at the player's option in his turn of play instead of the black straight line segments. The winner of each of the three advanced games is determined as the player having the largest point total obtained by adding the point value of the prize tokens won by that player. The winner is not necessarily the player who has the most prize tokens of his color on the gameboard since the captured black squares are worth three times as much as the captured black triangles.

The Game 1 gameboard is shown in FIG. 2 for illustrative purposes and assuming that the players quickly arrive at the gameboard condition illustrated in FIG. 2, the player whose turn it is to go has a critical decision as where to connect adjacent dots in order to minimize his opponent's opportunity to capture squares surrounded only by black segments. For example, if he connects across "a", his opponent wins only one square in his turn by connecting across "b". However, if the player connects across "g", "h" or "i", his opponent then wins 2 squares surrounded entirely by black segments because of his ability to go again every time he completes an entirely black square. In fact, if the player carefully studies the Game 1 gameboard, he will see that his preferred move is to connect the adjacent dots either across "m", "n" or "f" since in so doing his opponent cannot win any black squares because each one is blocked by the red stop segment. Thus, the red stops enhance the play value and the skill required to play and win.

FIG. 3 illustrates a composite of the Game 1 and Game 2 board with several of the red stop segments fixed at random locations with Game 1 being completed and the edges of Game 2 also being completed, that is, all of the dots which form Game 2 are interconnected and red stop segments extend between the Game 1 dots and the Game 2 dots as illustrated in FIG. 3. Assuming that the play has reached this condition, the player must study the board carefully in order to minimize the opportunity presented to his opponent to capture black squares. For example, if you place a segment across "a", your opponent wins one square by connecting across "b" but if you connect across "c", your opponent wins 4 squares by connecting in his turn across "d", the "e", then "f" and then "g" before he is stopped by the red stop from completing the next square in succession. The only way not to lose any square to your opponent at this time is to use one of the allowed optional red stop segments, but experience will show that this probably is not the most opportune time to do that and it might be wiser to lose the one square and shift the pressure onto your opponent as to where he must move. In the beginner game, Game 3 is played continuously after Game 2 is completed according to the same rules of play as Game 1. Thus, if three games are played, the winner of the match may be determined in a manner set forth previously.

In playing an advanced game, the three games are also played but now it is permitted to connect adjacent dots on the diagonals but no diagonals can cross each other so that in addition to capturing black squares, each player is allowed to capture black triangles with the point value of the black squares being three times the value of the captured black triangles. The red stops are used to control the advanced game since squares or triangles completed with one or more sides constructed from red stops do not count as captured squares or triangles. FIG. 4 illustrates an advanced Game 1 in play between two players. In this game, since the black squares are of triple value as compared to the black triangles, a player may give his opponent the chance to complete a black triangle rather than a black square in endeavoring to win the game. Also, when the opportunity presents itself, a player should complete a black square rather than a black triangle. For example, in FIG. 4 assuming that the play has reached the condition as illustrated, the player whose turn exists can complete black squares by placing black segments at "a", "b", "c", and "d" and then could complete black triangles by placing a diagonal segment at "e" and "f" and prevent his opponent from scoring by placing a "stop" segment at "g". As skills are developed and strategic planning conceived, various techniques of scoring and blocking opponents will be developed to provide an interesting and mentally stimulating game in which the outcome can be controlled by skills and stratagems rather than pure chance.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A dot game device comprising a gameboard having a generally planar upper surface and including a matrix of horizontally and vertically oriented dots including a central dot and a plurality of concentric rows of spaced dots with the central dot and the first two concentric rows of dots forming a first game and the next two concentric rows of dots forming a second and third game, a plurality of equal length straight line segments for connecting adjacent dots, a plurality of equal length non-straight line segments for connecting adjacent dots and game pieces in the form of generally circular tokens positionable in enclosed areas formed by straight line segments interconnecting adjacent dots to indicate an area captured by a player when the area is completely enclosed by straight line segments.

2. The structure as defined in claim 1 wherein said game pieces are distinguishably colored to enable players to record the capture of an area.

3. The structure as defined in claim 2 wherein the background areas of games 1, 2 and 3 on the gameboard are distinguishably colored.

4. The structure as defined in claim 3 wherein said straight line segments are black, said non-straight line segments being red and of zigzag configuration

5. The structure as defined in claim 4 wherein said game pieces are provided with numerical indicia to indicate the point value of an area enclosed by the straight line segments.

6. The structure as defined in claim 5 wherein said red zigzag segments form stop segments which interconnect certain of the adjacent dots to prevent the completion of an enclosed area by utilizing all straight line segments.

7. The structure as defined in claim 6 wherein each player posseses a limited number of red stop segments to be used wisely during play of a game to block an opponent from completing an enclosed area with straight line segments.

8. The structure as defined in claim 5 wherein said gameboard optionally includes only a predetermined number of fixed stop segments, only positionable stop segments or a combination of fixed and positionable stop segments.

9. A game device comprising a gameboard having a planar upper surface with a matrix of dots arranged in spaced horizontal and vertical rows with the dots being equally spaced from each other, a plurality of equal length line segments of a length substantially equal to the distance between adjacent dots for connecting adjacent dots to enclose an area by forming a perimeter of the area when connecting a plurality of dots by positioning a plurality of line segments between adjacent dots, a plurality of distinguishable tokens for positioning in the enclosed areas to indicate which player of the game completed that particular area, and a plurality of distinguishable segments connecting certain adjacent dots and forming a portion of a perimeter of an area which includes the two dots connected by the distinguishable segment thereby enabling observable distinction between an enclosed area including a perimeter formed only by line segments and an enclosed area defined by line segments and a distinguishable segment.

10. The game device as defined in claim 9 wherein said distinguishable segments are line segments of a distinguishable configuration positionable between certain adjacent dots by players of the game.

11. The game device as defined in claim 9 wherein said distinguishable segments are permanently formed on the gameboard.

12. The game device as defined in claim 9 wherein said dots are arranged in concentric arrays on the gameboard with the background of an inner array of dots being distinguishably colored from a concentric central array and an concentric outer array of dots to enable multiple games to be played on a single gameboard with the dots in the individual games being connected by line segments and distinguishable segments and enabling dots in concentric arrays to be interconnected by line segments and distinguishable segments extending from an inner array of dots to an outer array of dots with the dot arrays enabling enclosed areas of square and right triangular shape to be formed by the line segments and distinguishable segments.

* * * * *